US008278806B1

(12) United States Patent
Moskowitz

(10) Patent No.: US 8,278,806 B1
(45) Date of Patent: Oct. 2, 2012

(54) LED REFLECTOR LAMP

(75) Inventor: Warren P. Moskowitz, Ipswich, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 13/038,852

(22) Filed: Mar. 2, 2011

(51) Int. Cl.
*H05B 33/02* (2006.01)

(52) U.S. Cl. ..... 313/113

(58) Field of Classification Search ..... 313/512, 313/113
See application file for complete search history.

(56) References Cited

U.S. PATENT DOCUMENTS

| | | | | |
|---|---|---|---|---|
| 6,350,041 | B1 | 2/2002 | Tarsa et al. | |
| 6,474,826 | B1 * | 11/2002 | Tanaka et al. | 362/612 |
| 7,310,186 | B2 | 12/2007 | Lerner et al. | |
| 7,382,963 | B2 | 6/2008 | Chung | |
| 7,497,581 | B2 | 3/2009 | Beeson et al. | |
| 7,531,960 | B2 | 5/2009 | Shimizu et al. | |
| 7,710,669 | B2 | 5/2010 | Li | |
| 7,744,241 | B2 | 6/2010 | Xu | |
| 2004/0070337 | A1 * | 4/2004 | Goh et al. | 313/512 |
| 2005/0052873 | A1 | 3/2005 | Sokolov | |
| 2007/0263298 | A1 | 11/2007 | El-Ghoroury | |
| 2009/0231878 | A1 * | 9/2009 | Van Duijneveldt | 362/555 |

FOREIGN PATENT DOCUMENTS

| | | | |
|---|---|---|---|
| WO | 2006102846 | A1 | 10/2006 |
| WO | 2009020484 | A1 | 2/2009 |
| WO | 2010/044985 | A2 | 4/2010 |
| WO | 2010053528 | A2 | 5/2010 |
| WO | 2010/110652 | A1 | 9/2010 |
| WO | 2011/014672 | A1 | 2/2011 |

* cited by examiner

*Primary Examiner* — Anh Mai
*Assistant Examiner* — Hana Featherly
(74) *Attorney, Agent, or Firm* — Robert F. Clark

(57) ABSTRACT

An LED reflector lamp is provided wherein the lamp has a concave reflector substantially symmetrically arrayed about an axis, the reflector further having a focus and a bottom. A subassembly is coaxially aligned with said axis and comprises a light guide having a proximal end positioned outside of said reflector and a distal end positioned within said reflector at said focus. A first light source comprising at least one light emitting diode (LED) is positioned at said proximal end and operable to emit a first radiation when energized. A second light source comprising at least one phosphor is positioned at said distal end and operable to emit a second radiation having a different wavelength than said first radiation when energized by said first radiation from said first light source.

11 Claims, 5 Drawing Sheets

LED REFLECTOR LAMP

TECHNICAL FIELD

This invention relates to lamps utilizing light emitting diodes (LED or LEDs) and phosphors. Such lamps are called "phosphor-converted" lamps and will often be referred to as such herein.

BACKGROUND OF THE INVENTION

Numbers of light sources have been proposed as replacements for the ubiquitous incandescent lamp and prominent among these are phosphor-converted lamps employing LEDs as the primary light source, with the use of a phosphor as a secondary light source. Chief among the latter type of lamp are those using blue-emitting LEDs having a phosphor layer immediately above the LED. The visible blue and/or ultraviolet light emitted by the LED energizes the phosphor to emit a substantially yellow light, the blue and yellow radiation combining to make an acceptable white light.

The end result of this system provides an initial source of light that covers a small area but with a wide, angularly dispersed white light source. The product of the source area and the solid angle of its output is known as etendue and is a quantity that cannot be reduced without loss as the light makes its way through an optical system. Owing to the power dissipation limitations of individual LEDs, one must combine the outputs of multiple LEDs to produce a useful reflector lamp and this condition is certainly true with respect to PAR lamps. The combination of multiple light sources necessarily increases the etendue of the system. Because of practical limitations, the etendue of the combined system includes a large amount of non-light producing areas that exist between the multiple LEDs. The result is a light distribution that requires a large reflector or other optical element to produce a narrow-angle beam. Additionally, some type of homogenizer or diffuser is usually required to reduce the perception of the individual LED chips.

Another problem that exists with use of phosphor to provide a specific light output from LEDs resides in the fact that the phosphor layer generates heat because of the so-called stokes shift or the difference in energy between the blue excitation photons and the lower energy emission. This heat is undesirable when it is close to the LEDs, which are very intolerant of elevated temperatures.

It has been suggested that the problem caused by excessive heat can be mitigated by placing the phosphor in a hemispherical silicone rubber dome, which dome is placed over the LED. While this approach achieves some beneficial improvement, it does not reduce the etendue problem; it actually increases it.

SUMMARY OF INVENTION

It is, therefore, an object of the invention to obviate at least some of the above enumerated disadvantages of the prior art.

It is another object of the invention to enhance light sources.

Yet another object of the invention is the improvement of light sources employing LEDs.

Still another object is the minimization of the etendue of LED-driven phosphor-converted lamps.

It is another object of the invention to create a light source with a small size and narrow beam whose output is free of undesirable angular or color irregularities.

A still further goal is the creation of an energy efficient lamp, particularly a lamp utilizing a reflector.

These objects are accomplished, in one aspect of the invention, by the provision of an LED reflector lamp having a concave reflector substantially symmetrically arrayed about an axis and having a focus and a bottom. A subassembly is coaxially aligned with said axis and comprises a light guide having a proximal end positioned outside of said reflector and a distal end positioned within said reflector at said focus. A first light source comprising at least one light emitting diode (LED) is positioned at said proximal end and operable to emit a first radiation when energized. A second light source comprising at least one phosphor is positioned at said distal end and operable to emit a second radiation having a different wavelength than said first radiation when energized by said first radiation from said first light source.

Positioning of the second light source remote from the first light source greatly reduces temperature anomalies and allows the etendue to be minimized, providing for the creation of a phosphor-converted lamp with a small size and a narrow beam angle, whose output has minimal undesirable angular or color irregularities.

DETAILED DESCRIPTION THE INVENTION

Figure 1:
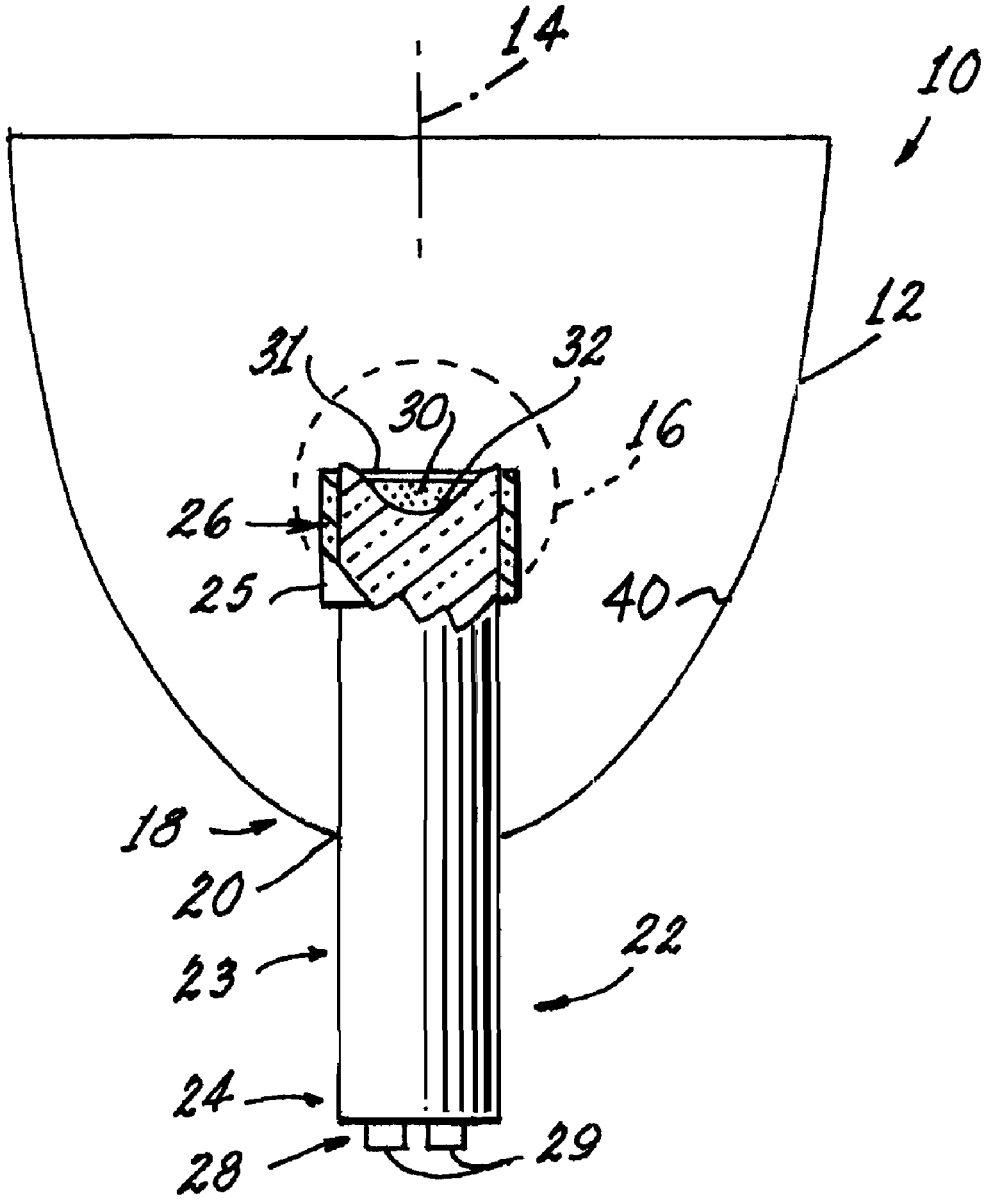
FIG. 1 is a diagrammatic representation of an embodiment of the invention.

For purposes of this application it is to be understood that when an element or layer is referred to as being "on," "connected to" or "coupled to" another element or layer, it can be directly on, connected to or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. The term "and/or" includes any and all combinations of one or more of the associated listed items.

Although the terms "first," "second," "third" etc. may be used to describe various elements, components, regions, layers and/or sections, these elements, components, regions, layers and/or sections are not to be limited by theses terms as they are used only to distinguish one element, component, region, layer and/or section from another element, component, region, layer and/or section. Thus, a first element, component, region, layer or section could be termed a second element, component, region, layer or section without departing from the scope and teachings of the present invention.

Spatially relative terms, such as "beneath," "below," "upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. For example, as used herein, the singular forms "a," "an" and "the" are intended to include the plural forms as well, unless the context clearly indicates otherwise. It will be further understood that the terms, "comprises" and/or "comprising," when used in this specification, specify the presence of stated features, integers, steps operations, elements, and/or components, but do not preclude the presence or addition of one or more other features, integers, steps, operations, elements, components, and/or groups thereof.

For a better understanding of the present invention, together with other and further objects, advantages and capabilities thereof, reference is made to the following disclosure and appended claims taken in conjunction with the above-described drawings.

Figure 2:
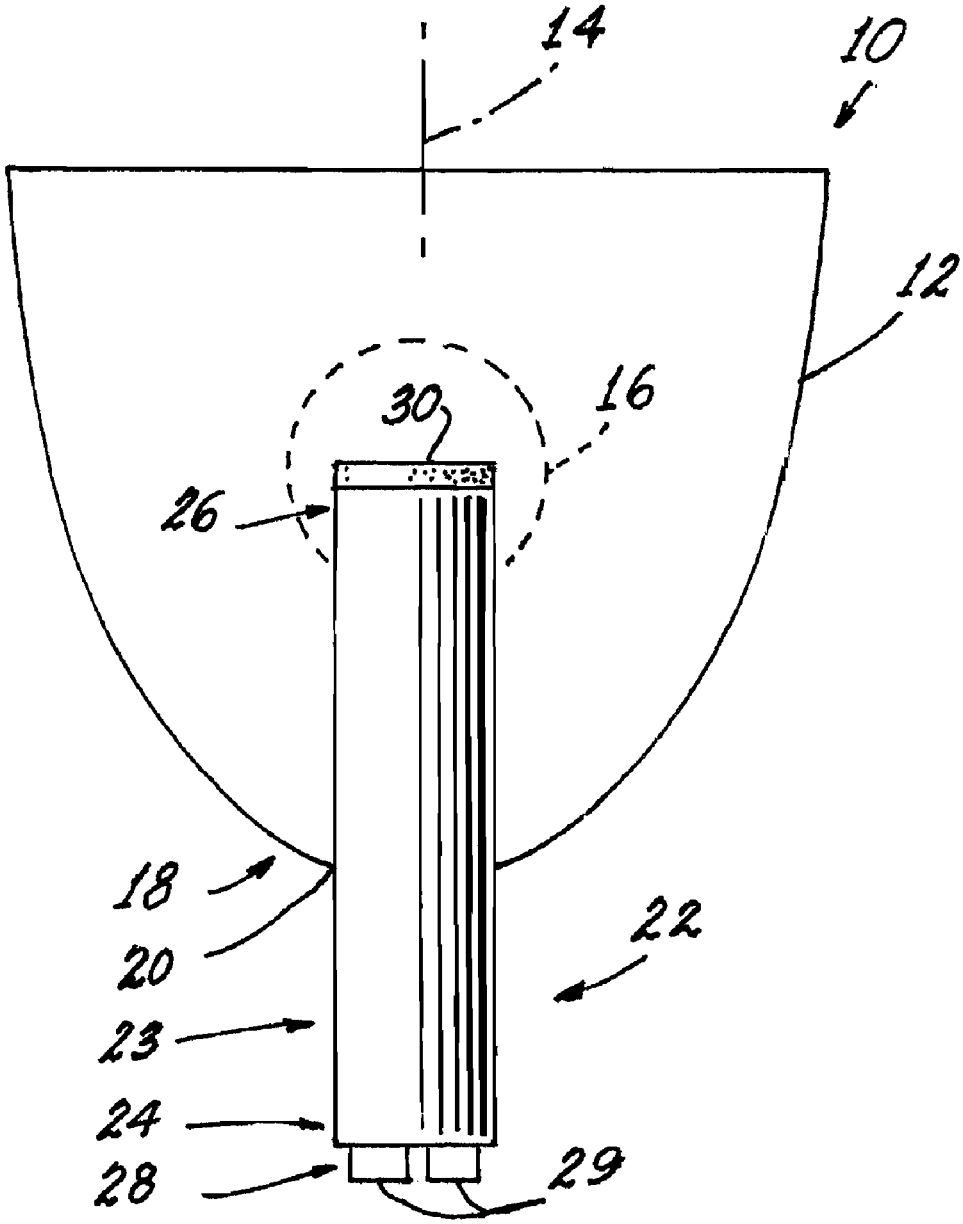
FIG. 2 is a diagrammatic representation of a second embodiment of the invention.

Referring now to the drawings with greater particularity there is shown in FIG. 1 an LED reflector lamp according to an embodiment of the invention. The lamp 10 comprises a concave reflector 12 substantially symmetrically arrayed about an axis 14 and having a focus 16 and a bottom 18. The term "substantially symmetrically arrayed" as used herein means that the reflective surface that forms the optically active part of the reflector exhibits substantially the same cross-sectional curvature in any of half planes including, and extending from, the axis which intersect with the reflector. This applies to both reflectors which extend a full 360° about the axis (e.g., FIGS. 1-3) and reflectors which extend only partly about the axis (e.g., FIGS. 4 and 5).

The reflector 12 can have any desired configuration, such as hyperbolic or parabolic; however, parabolic is preferred. Preferably, the reflector extends 360° about the axis. However, other configurations are possible wherein the reflector extends only partially about the axis. The inner reflective surface 40 of reflector 12 comprises the optically active part of the reflector 12. The reflective surface preferably comprises an aluminized or silvered surface or a highly polished metallic surface. An aperture 20 is formed in the bottom 18 and a subassembly 22 is positioned in the aperture and is coaxially aligned with the axis 14. The subassembly 22 comprises a light guide 23 having a proximal end 24 positioned outside of the reflector 12 and a distal end 26 positioned within the reflector 12 at the focus 16.

A first light source 28 comprising at least one light emitting diode (LED) is positioned at the proximal end 24 and is operable to emit a first radiation when energized by a power supply (not shown) which may be external to the lamp. In a preferred embodiment of the invention the first light source 28 comprises a plurality of LEDs 29 that emit radiation in the wavelength range of 290 nm to 490 nm. More preferably, the LEDs emit a blue light having a wavelength from 420 nm to 490 nm.

A second light source 30 comprising at least one phosphor is positioned at the distal end 26 of the light guide 23, the second light source 30 being operable to emit a second radiation when energized by radiation from the first light source 28. The second light source 30 preferably comprises one or more phosphors that are stimulated to emit light in the visible region of the electromagnetic spectrum, for example, in the yellow (approximately within the range of 570 nm to 610 nm). For example, the second light source 30 could be a blend of different colored-light emitting materials that alone or in combination with the light from the LED add together to produce white light or other desired spectral distribution. A preferred phosphor is a cerium-activated yttrium aluminum garnet phosphor. One component of the phosphor blend could comprise passive scattering particles that simply scatter a portion of the LED light isotropically for collection by the reflector. The reflector 12 captures and re-directs the light emitted from the distal end of the light guide.

The light guide 23 can be cylindrical or tubular, although cylindrical is preferred, and the light guide should exhibit total internal reflection (TIR) to the extent possible to confine the light emitted by the LEDs. Alternatively, the light guide 23 can be coated with a reflecting coating over most of its surface and/or a dichroic antireflective coating 25 can be provided on the outer surface of the light guide 23 near the focus to reduce any phosphor emission that gets trapped in the light guide 23. If a tubular guide 23 is employed the distal end 26 should be closed.

The distal end 26 as shown in FIG. 1 is provided with a depression 32 and the second light source 30 is positioned within the depression 32. Preferably, the second light source 30 is covered by a reflective coating 31, such as aluminum, to further suppress emission that might miss the reflector, taking such emission and directing it toward the reflector 12. In the alternate embodiments shown in FIGS. 2 and 3 the distal end 26 can be substantially planar.

When the depression or cavity 32 is used, preferably it has a shape that is designed to maximize phosphor excitation by the first radiation and subsequent light collection by the reflector. For example, forward scattered emission that might miss the reflector and emerge at wide angles could be considered undesirable. An approximately parabolic shape, or a small fraction of a sphere is appropriate for the depression 32.

Figure 3:
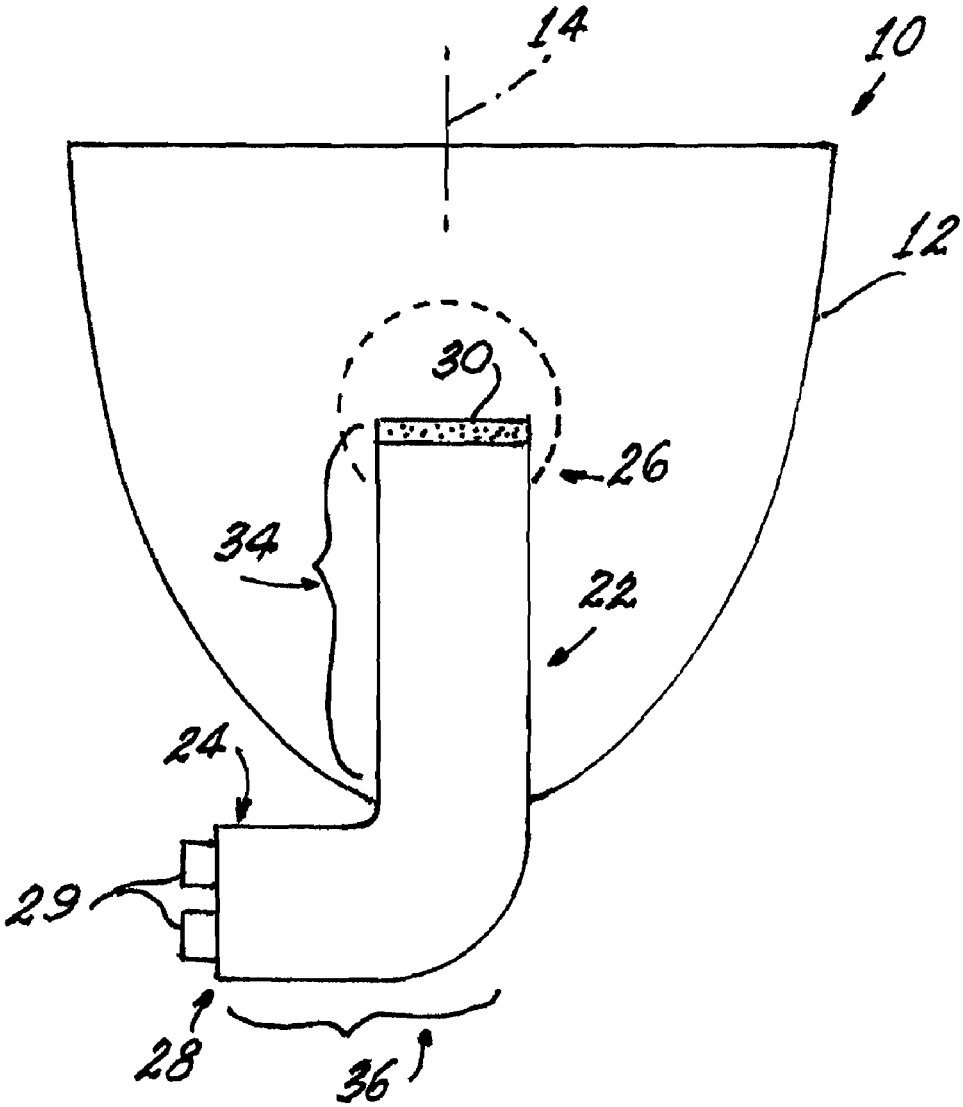
FIG. 3 is a similar view of yet another embodiment of the invention.

The flexibility of the design is illustrated in FIG. 3 wherein the subassembly 22 is comprised of an internal section 34 and an external section 36 with only the internal section 34 being coaxial with said axis 14.

Figure 4:
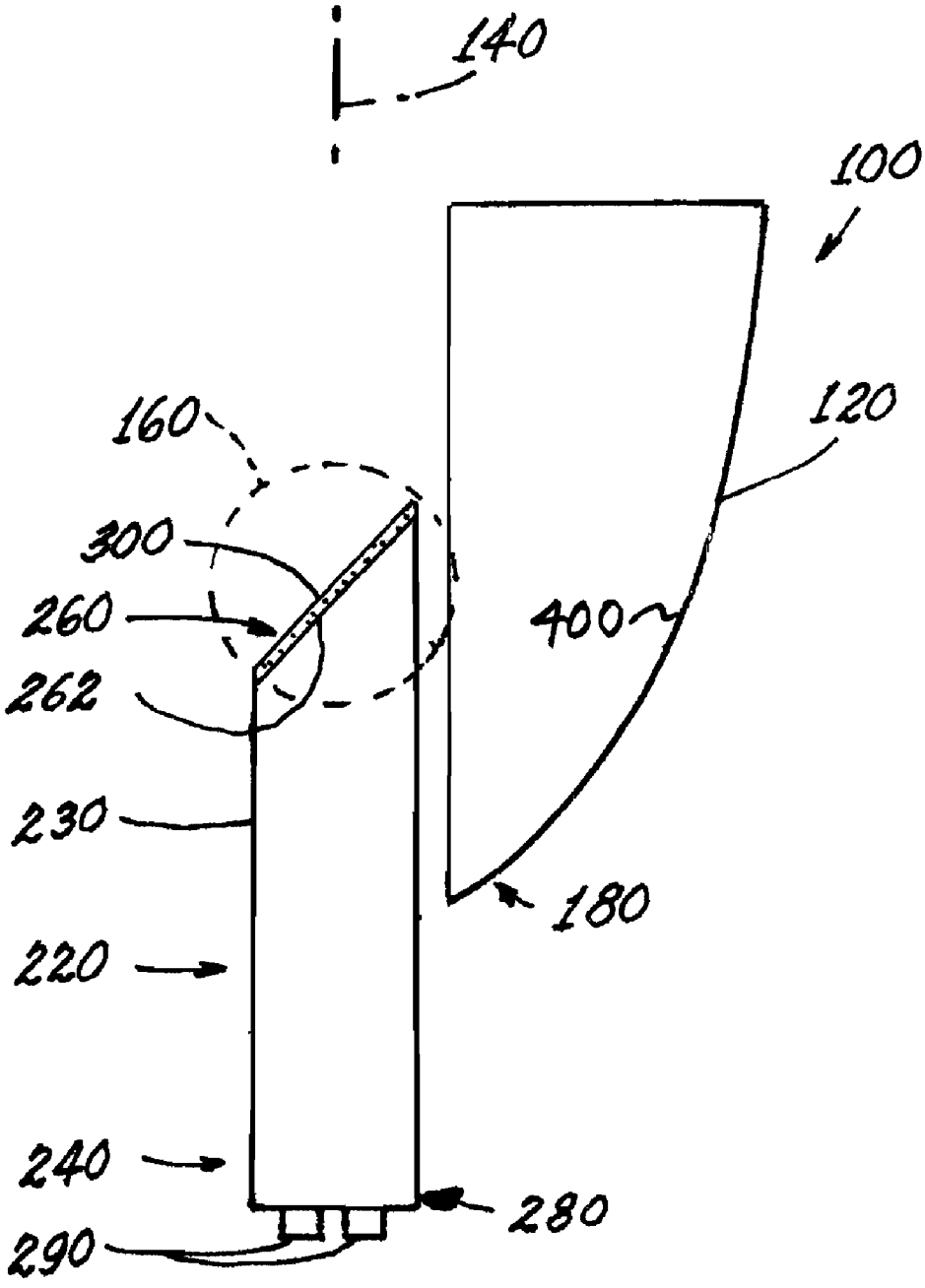
FIG. 4 is a diagrammatic representation of still another embodiment of the invention.

Yet another embodiment of the invention is illustrated in FIG. 4 wherein a lamp 100 has a partial reflector 120 that is substantially symmetrically arrayed about an axis 140 and has a focus 160. Preferably, in this embodiment, the partial reflector 120 and its reflective surface 400 extend no more than 180° about the axis 140. In such a case the distal end 260 of a light guide 230 has an angled top 262 formed at angle that is less than 90 degrees with respect to the axis. The second light source 300 is applied to the angled top 262. The first light source 280 can be LEDs 290 positioned at the proximal end 240 of the subassembly 220. The light guide 230 can be positioned adjacent an end 180 of the reflector 120.

Figure 5:
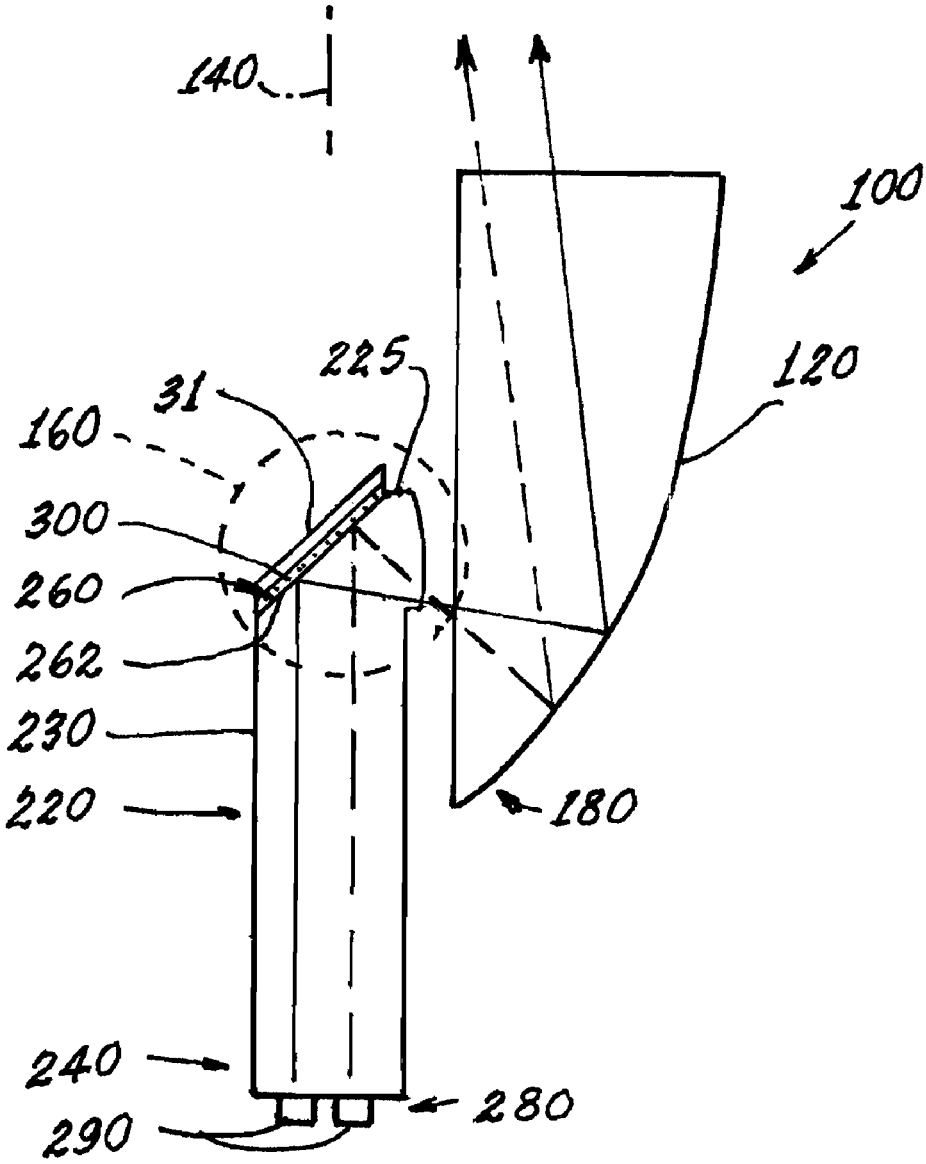
FIG. 5 is a diagrammatic representation of yet another embodiment of the invention.

FIG. 5 illustrates an embodiment similar to that of FIG. 4 wherein the light guide 230 has a right-angled portion 225 that protrudes from the light guide 230 and faces the interior of the reflector 120. In this instance, also, the distal end 260 of the light guide 230 has an angled top 262 formed at an angle that is less than 90 degrees and carrying the second light source 300. The forward surface of the right-angled portion 225 can be curved to provide additional lensing. Further, if desired, the second light source 300 can be covered by a reflective material 31, e.g., an aluminum layer.

Thus, there is provided a light source that eliminates or reduces many of the disadvantages of the prior art. Since the LEDs are positioned outside of the reflector, the LED reflector lamp may be made to have a small size, narrow beam, and low etendue. Moreover, the position of the phosphor at the end of the light guide helps reduce undesirable angular or color irregularities in the light output from the lamp.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An LED reflector lamp comprising:

a concave reflector substantially symmetrically arrayed about an axis and having a focus and a bottom, and wherein said concave reflector extends no more than 180° about said axis;

a subassembly coaxially aligned with said axis, said subassembly comprising a light guide having a proximal end positioned outside of said reflector and a distal end positioned within said reflector at said focus;

a first light source comprising at least one light emitting diode (LED), said first light source being positioned at said proximal end and operable to emit a first radiation when energized; and a second light source comprising at least one phosphor, said second light source being positioned at said distal end and operable to emit a second radiation having a different wavelength than said first radiation when energized by said first radiation from said first light source.

2. The lamp of claim 1 wherein said distal end is provided with a depression and said second light source is positioned within said depression.

3. The lamp of claim 1 wherein said first light source 28 emits radiation having a wavelength from 290 nm to 490 nm.

4. The lamp of claim 1 wherein said subassembly is comprised of an internal section and an external section with only the internal section being coaxial with said axis.

5. The lamp of claim 1 wherein said light guide has an angled top at said distal end and said second light source is positioned on said angled top.

6. The lamp of claim 5 wherein a reflective coating is positioned on said second light source.

7. The lamp of claim 5 wherein said light guide has a right-angled portion adjacent to said angled top and facing said reflector, said right-angled portion protruding from light guide and having a curved surface.

8. The lamp of claim 1 wherein said second light source has a reflective coating.

9. The lamp of claim 1 wherein said light guide has an antireflective coating at said distal end.

10. The lamp of claim 1 wherein said reflector is a parabolic reflector.

11. The lamp of claim 1 wherein said reflector is a hyperbolic reflector.

* * * * *